US006309047B1

(12) United States Patent
Mantell et al.

(10) Patent No.: US 6,309,047 B1
(45) Date of Patent: Oct. 30, 2001

(54) EXCEEDING THE SURFACE SETTLING LIMIT IN ACOUSTIC INK PRINTING

(75) Inventors: David A. Mantell, Rochester, NY (US); Richard N. Ellson, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/444,612

(22) Filed: Nov. 23, 1999

(51) Int. Cl.[7] ..... B41J 2/135
(52) U.S. Cl. ..... 347/46
(58) Field of Search ..... 347/46, 12, 15, 347/41; 358/258

(56) References Cited

U.S. PATENT DOCUMENTS

| | | |
|---|---|---|
| 4,308,547 | 12/1981 | Lovelady et al. . |
| 4,697,195 | 9/1987 | Quate et al. . |
| 4,719,476 | 1/1988 | Elrod et al. . |
| 4,748,453 | 5/1988 | Lin et al. . |
| 4,748,461 | 5/1988 | Elrod . |
| 5,216,451 | 6/1993 | Rawson et al. . |
| 5,229,793 | 7/1993 | Hadimioglu et al. . |
| 5,450,107 | 9/1995 | Rawson . |
| 5,629,724 | 5/1997 | Elrod et al. . |
| 5,808,636 | 9/1998 | Stearns . |
| 5,870,112 | 2/1999 | Kang et al. . |
| 5,919,354 | 7/1999 | Bartek . |

*Primary Examiner*—John Barlow
*Assistant Examiner*—Michael S. Brooke
(74) *Attorney, Agent, or Firm*—Fay, Sharpe, Fagan, Minnich & McKee, LLP

(57) ABSTRACT

In an acoustic ink printing system, the time between droplet ejection in predetermined cases is increased where full optical density is not required. This is accomplished by choosing an order in which drops are ejected to be strictly alternate whenever possible. In a system which has a 10 maximum ink droplet per pixel only requires, for example, five drops for a particular situation, twice as much time is available for settling of an ink surface than would be available for sequential bursts of droplets. The longer ink surface settling time allows for high ink droplet directionality control. When more than five drops per area are needed, less time exists between droplet ejection, increasing droplet misdirectionality. This drop misdirectionality will occur within shadow or dark regions where it has been shown in many cases to be helpful in providing coverage of the substrate.

20 Claims, 5 Drawing Sheets

EXCEEDING THE SURFACE SETTLING LIMIT IN ACOUSTIC INK PRINTING

BACKGROUND OF THE INVENTION

This invention relates to acoustic ink printing, and more particularly to a method and apparatus that allows an acoustic ink printer to operate at operational speeds greater than previously achievable and, which extends the ink types which may be used with the acoustic ink printer, while at the same time ensuring appropriate ink drop ejection directionality to achieve desired output printing.

It has been shown that acoustic ink printers which have printheads comprising acoustically illuminated spherical or Fresnel focusing lenses can print precisely positioned picture elements (pixels) at resolutions that are sufficient for high-quality printing of complex images.

Although acoustic lens-type droplet emitters currently are favored, there are other types of droplet emitters which may be utilized for acoustic ink printing, including (1) piezoelectric shell transducers, such as described in Lovelady et al., U.S. Pat. No. 4,308,547, and (2) interdigitated transducers (IDTs), such as described in commonly assigned U.S. Pat. No. 4,697,195. Furthermore, acoustic ink printing technology is compatible with various printhead configurations; including (1) single emitter embodiments for raster scan printing, (2) matrix configured arrays for matrix printing, and (3) several different types of page and width arrays, ranging from (i) single row sparse arrays for hybrid forms of parallel/serial printing, and (ii) multiple row staggered arrays with individual emitters for each of the pixel positions or addresses within a page width address field (i.e., single emitter/pixel/line) for ordinary line printing.

For performing acoustic ink printing with any of the aforementioned droplet emitters, each of the emitters launches a converging acoustic beam into a pool of ink, with the angular convergence of the beam being selected so that it comes to focus at or near the free surface (i.e., the liquid/air interface) of the pool. Moreover, controls are provided for modulating the radiation pressure which each beam exerts against the free surface of the ink. That permits the radiation pressure from each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

An attraction of acoustic ink printing is the ability to control droplet size based on the frequency of the signal provided, rather than relying on the size of the nozzle emitting the droplet. For example, an acoustic ink printer may emit droplets which are a magnitude or more smaller than the acoustic ink printhead openings. On the other hand, conventional ink jet printing requires a minimization of the nozzle itself to obtain smaller droplets.

Ideally, in an acoustic ink printer, the acoustic wave propagates in a direction perpendicular to the air-ink surface. The acoustic wave causes a droplet to be ejected in a direction which is parallel to the direction of the acoustic wave propagates. Thus, ideally the droplet is ejected in a direction perpendicular to the air-ink interface. To achieve high-quality printing, it has been considered necessary that the direction of droplet ejection must be the same for all ejectors across a printhead. Very slight misdirections cause droplets to land on a substrate, e.g., paper, at a location distant from their intended locations.

Typically, a 1 mm gap separates the air-ink interface from the substrate. A droplet ejected one degree off from the ideal ejection direction is displaced 17.5 $\mu$m from its intended location on the substrate. For a 1200 spi (spots per inch) printer, this displacement constitutes 80% of one pixel. Thus, in existing systems it has been a high priority to ensure that the direction of ejection of the droplets must be controlled very closely to achieve high-quality printing.

A common cause of misdirectionality is that waves generated from a previous droplet ejection have not settled sufficiently before the next droplet is ejected.

Thus, for conventional acoustic ink printing systems, a design constraint is the time between droplet ejection must be sufficient so as to ensure settling of the surface acoustic waves so that the next ejected droplet maintains good directionality as it moves toward the substrate. In this regard, time required for acoustic waves to settle is a fundamental limit on the print speed of an acoustic ink printer.

Ink settling time decreases with increased ink surface tension. Thus, aqueous inks in acoustic ink printing tend to be high-surface tension inks.

Substantial effort has been directed to improving the directionality of the ink droplets ejected from an acoustic ink ejector, and to designs which decrease the ink settling time, in order to increase printing speed. Examples of efforts in these areas are described in many commonly assigned U.S. patents including: U.S. Pat. No. 4,697,195 entitled Nozzleless Liquid Droplet Ejectors; U.S. Pat. No. 4,748,453 Entitled Spot Deposition for Liquid Ink Printing; U.S. Pat. No. 4,748,461 Entitled Capillary Wave Controllers for Nozzleless Droplet Ejectors; U.S. Pat. No. 4,719,480 entitled Spatial Stabilization of Standing Capillary Surface Waves; U.S. Pat. No. 4,719,476 entitled Spatially Addressing Capillary Wave Droplet Ejectors and the Like; U.S. Pat. No. 5,919,354 entitled Method and Apparatus for Suppressing Capillary Waves in an Ink-jet Printer; U.S. Pat. No. 5,229,793 entitled Liquid Surface Control with an Applied Pressure Signal in Acoustic Ink Printing; U.S. Pat. No. 5,216,451 entitled Surface Ripple Wave Diffusion in Apertured Free Ink Surface Level Controllers for Acoustic Ink Printers; U.S. Pat. No. 5,450,107 entitled Surface Ripple Wave Suppression by Anti-reflection in Apertured Free Ink Surface Level Controllers for Acoustic Ink Printers; U.S. Pat. No. 5,629,724 entitled Stabilization of the Free Surface of Liquid; U.S. Pat. No. 5,808,636 entitled Reduction of Droplet Misdirectionality in Acoustic Ink Printing; U.S. Pat. No. 5,870,112 entitled Dot Scheduling for Liquid Ink Printers, all hereby incorporated by reference.

Various ones of the above references specifically note the importance of directionality in acoustic ink printing as well as the importance of surface waves in achieving desired directionality.

However, the ink ejection process in these documents, as well as the conventional state of the art, is to provide a sequential burst of ink droplets when printing to a substrate or to generate a checkerboard type print output.

Checkerboard printing is a two pass process, wherein each pass prints a portion of the pixels in a dot pattern known as a "checkerboard" pattern. In this type of two pass printing, a first pass of the printhead carriage prints a swath of information in which odd numbered pixels of odd numbered rows or scanlines and even numbered pixels of even numbered rows or scanlines of a bitmap are printed. In a second pass of the carriage printhead, the complementary pattern consisting of even numbered pixels in odd numbered rows and odd numbered pixels in even numbered rows is printed. By printing in two passes, the ink printed in the first pass has time to dry partially before the ink from the second pattern is deposited.

The cited material does not however, recognize the potential benefits of relaxing ink ejection constraints when in a dark/shadow image area, and thus does not apply this understanding through the use of specialized filler patterns which adjust ink droplet ejection.

While other printing arts such as those using half-toning concepts do include the concept of staggered or varying print sequences (i.e., as in the generation of half-tone cells,) such use is directed towards achieving a desired tone scaling. In other words, in half-toning it is desirable to provide smooth transition variations during printing and that is where the half-toning print sequences are directed. However, the concepts of the present invention are specifically directed to directionality and are not concerned with such tone scaling concepts.

The present invention departs from conventional acoustic ink printer designs which have constraints on firing frequency due to the need to allow an ink surface to settle sufficiently before a next ejection. The invention also takes advantage of the inventor's understanding that constraints against misdirectionality within dark or shadow areas of an image may be relaxed in a beneficial manner. It is noted the constraints of existing systems result in an inherent limitation on the speed with which a device may print. For example, existing systems based on aqueous inks, are known to have an upper level operating frequency of 48 kHz.

In consideration of the above, it has been deemed desirable to develop an apparatus and method directed to maintaining high directionality control of droplet ejections during the printing of image areas with predetermined first optical density requirements, while at the same time relaxing certain constraints which will increase misdirectionality of droplet ejection when printing image areas which have an optical density greater than the first optical density. Such constraints are directed to the time between droplet ejection required for the settling of an ink surface.

SUMMARY OF THE INVENTION

It is an object of the invention to provide an apparatus and method which relaxes the design constraints of conventional systems to ensure sufficient settling of the surface acoustic waves for each droplet ejection, to maintain directionality control of all ejected drops as they are propelled toward a substrate.

The present invention provides an increase in the time between drop ejection in cases where full density printing is not required. The relaxation is accomplished by choosing an order of droplet ejection which permits, where physically possible, strictly alternate drop ejection in lower print density areas thereby maintaining desired control of droplet directionality, while control of drop ejection in higher print density areas permits droplet misdirectionality. The implemented droplet control allows the overall operating speed of the acoustic ink printer to be increased and/or ink having properties with lower surface tensions than previously determined allowable by design constraints to be used.

In accordance with a more limited aspect of the present invention, the order of droplet ejection takes place in accordance with a filler pattern supplied from a controller to individual acoustic ink ejectors, in order to maintain directionality during printing of low optical density areas while providing beneficial misdirectionality in the high-density dark or shadow regions of an image.

A first benefit of the present invention is an ability to operate the acoustic ink printing system at an operating speed higher than previously considered appropriate.

With attention to another aspect of the present invention, inks which were previously believed to be non-compatible with design constraints of the acoustic ink printer may be now implemented.

Still further advantages of the present invention will become apparent to those of ordinary skill in the art upon reading and understanding the following detailed description of the preferred embodiment.

DETAILED DESCRIPTION OF THE PREFERRED EMBODIMENTS

Figure 1:
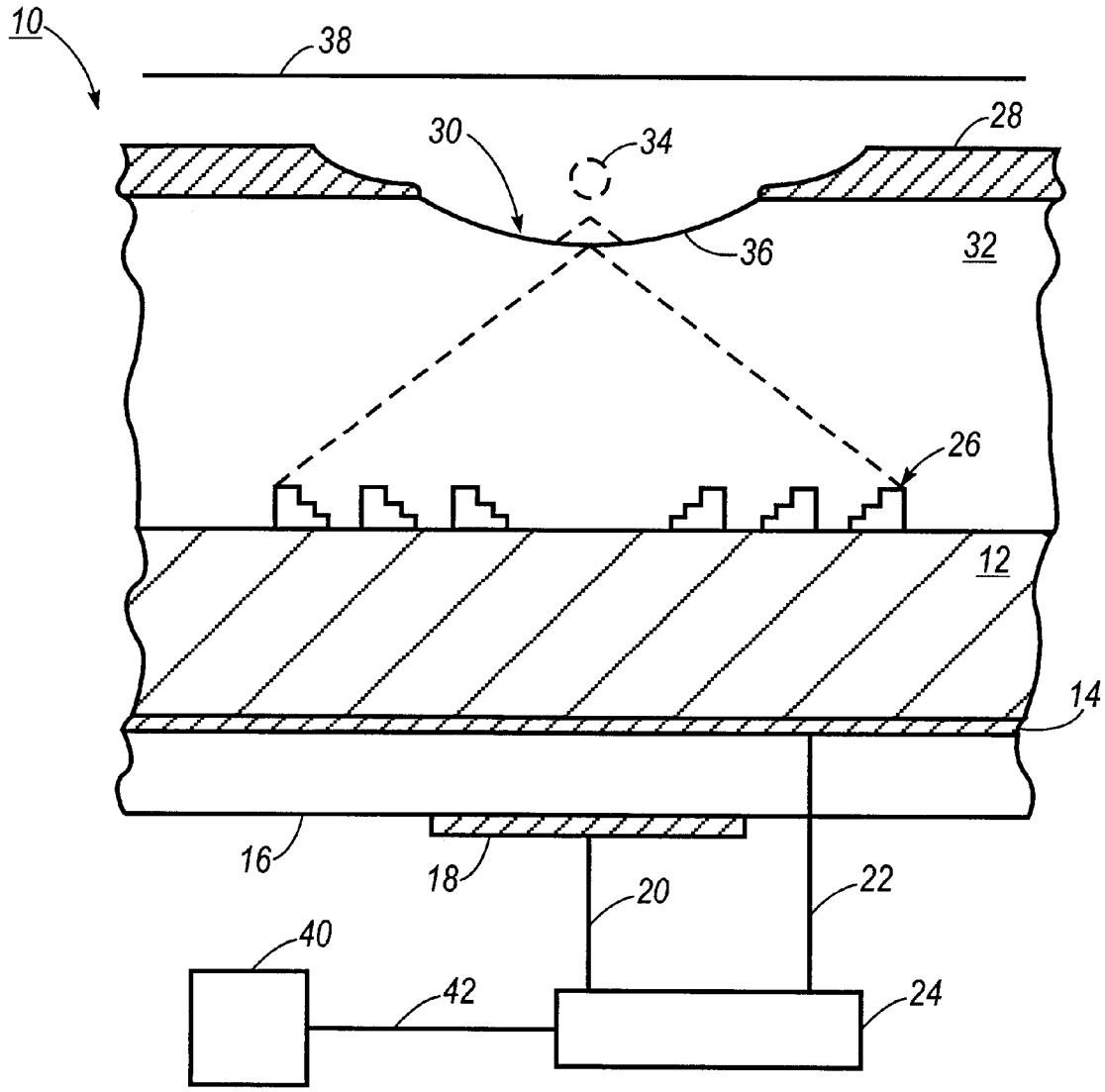
FIG. 1 is a simplified design of a single ejector for an acoustic ink printhead system.

Referring now to the drawings which are provided for illustrating the preferred embodiments of the invention only and not for purposes of limiting same, FIG. 1 provides a view of an exemplary acoustic ink printing ejector 10 to which the present invention is directed. Of course, other configurations may also have the present invention applied thereto.

Additionally, while a single ejector is illustrated, an acoustic ink printhead will consist of a number of the ejectors arranged in an array configuration, and the present invention is intended to work with such an array.

As shown, ejector 10 includes a glass layer 12 having an electrode 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown by lines 20 and 22 to a radio frequency (rf) power source 24 which generates power that is transferred to the electrodes 14 and 18. On a side opposite the electrode layer 14, a lens 26, such as a concentric Fresnel lens or other appropriate lens, is formed. Spaced from the lens 26 is a liquid level control plate (also called an orifice plate) 28, having an orifice 30 formed therein. Ink 32 is retained between the orifice plate 28 and the glass layer 12. The orifice 30 is aligned with the lens 26 to facilitate emission of a droplet 34 from ink surface 36 to a substrate 38. Ink surface 36 is, of course, exposed by the orifice 30.

The lens 26, the electrode layer 14, the piezoelectric layer 16 and the electrode 28 are formed in the glass layer 12 through photolithographic techniques. The orifice plate 28 is subsequently positioned to be spaced from the glass layer 12. The ink 32 is fed into the space between the orifice plate 28 and the glass layer 12 from an ink supply (not shown but such supply is well known in the art).

A controller 40 generates control signals 42 which are selectively supplied to rf power source 24. Upon receipt of an appropriate control signal 42, ink droplet ejection is initiated, causing droplet 34 to be ejected.

As previously noted, due to the requirement of allowing the ink surface to settle prior to ejection of each droplet, to avoid droplet misdirectionality, the speed of the existing systems are constrained, and various types of inks having lower surface tension having longer settling times. For example, an acoustic ink printing system which has a maximum of ten drops to an area, i.e. a pixel area, is known to operate at approximately 48 kHz for use with a high-surface tension ink. It was observed by the inventors that in existing systems the controller would send bursts of control signals to rf power source 24, to thereby cause a sequence of ink droplets to be ejected each immediately following the other.

For example, if up to ten droplets can be printed in an area, i.e. in a pixel, and for a particular image the selected pixel requires only six droplets, then the device would generate six droplets sequentially. Similarly, if two droplets were required, then two droplets would be sequentially generated, etc. This design requires the device operating frequency (the time between sequential drops) to be sufficiently slow to allow the ink surface to resettle prior to the next time adjacent droplet ejection, in order to maintain drop directionality for each ejected droplet.

The present proposal is to design acoustic ink printers to print up to ten drops per pixel for each color. The "normal mode" for such printing is to divide these drops into two groups. During a first pass, the printhead will print up to five drops, and on a second pass up to the next five drops are ejected.

One embodiment of the present invention is to reorder the drops to be printed from a sequential burst into a substantially alternating pattern. A basic filler pattern would have a first group of filler pattern data (e.g. 1, 3, 5, 7, 9) and filler pattern data (e.g. 2, 4, 6, 8, 10) in a second group. In a situation where the level of drops to be included within a pixel are ten, the preceding pattern would simply eject five drops on the first pass (i.e. corresponding to the filler data 1, 3, 5, 7 and 9) and five drops on the second pass corresponding to the supplied filler pattern data (i.e. 2, 4, 6, 8, 10). Thus if a full ten-droplet printing were required, a sequential type emission would exist. However, when the level of droplets to be included within a pixel are less than ten, benefits of the present invention come into play. For example, if the number of droplets to be placed in a pixel are five, then on a first pass, droplets would be ejected corresponding to filler pattern data 1, 3, and 5, and also on the first pass no droplets would be ejected when filler data pattern received is 7 and 9. On the second pass, droplets would be ejected when filler pattern data of 2 and 4 is received, whereas no droplets would be ejected when filler pattern data 6, 8 or 10 is received.

While the above is discussed in connection with a single pixel, it is to be appreciated that multiple pixels are to be printed on a line. The preceding discussed pattern will provide a checkerboard pattern from pixel to pixel in order to prevent all "1" drops from printing at the same pass. Thus, in consideration of multiple pixel printing and where the input level to each pixel is five, the printing pattern would be XXX00 (i.e. 1,3,5,7,9) on the first pass, and XX000 (i.e. 2,4,6,8,10) on the return pass for the first pixel (where the X stands for printing a drop, and 0 stands for not printing). In consideration of the checkerboarding concept of printing discussed, the next pixel would be printed with a first pass of XX000 (i.e. 2,4,6,8,10) and a second pass of XXX00 (i.e. 1,3,5,7,9).

It is to be noted that once the pixel requires three or greater drops, two of the drops will always be printed in adjacent cycles in one of the passes. Thus, under the foregoing scenario, the acoustic ink printer would still be tied to the intrinsic drop rate of the printer that will allow for a settling of the ink surface.

The following embodiments are directed to providing a filler pattern which allows the acoustic ink printer to go beyond what is considered the intrinsic drop rate of the device while at the same time maintaining the drop directionality, which result in high quality prints.

An important concept of the present invention is that when a printer is printing in an area which is high density, i.e. in the shadow or black area of an image, then it is acceptable to have some misdirectionality from the ejector, which allows the ejector to scatter ink droplets in areas not otherwise appropriate. Particularly, since the shadow/black areas are going to be black or dark in any case, there is no overall decrease in print quality, and in fact, there may be an increase in print quality by allowing a relaxation of droplet directionality constraints.

Implementing this concept makes it possible to operate an acoustic ink printer at a higher speed than what was previously an accepted optimal speed. When not in dark or shadow regions, the filler patterns provide time between the ejected droplets, delivering them across the whole drop cycle such that they are not ejected at times immediately adjacent to each other. Providing a time period between the ejected droplets allows for the ink surface to stabilize to a degree which results in the desired directionality for these mid-range (i.e. non-black/shadow) areas.

Figure 2A:
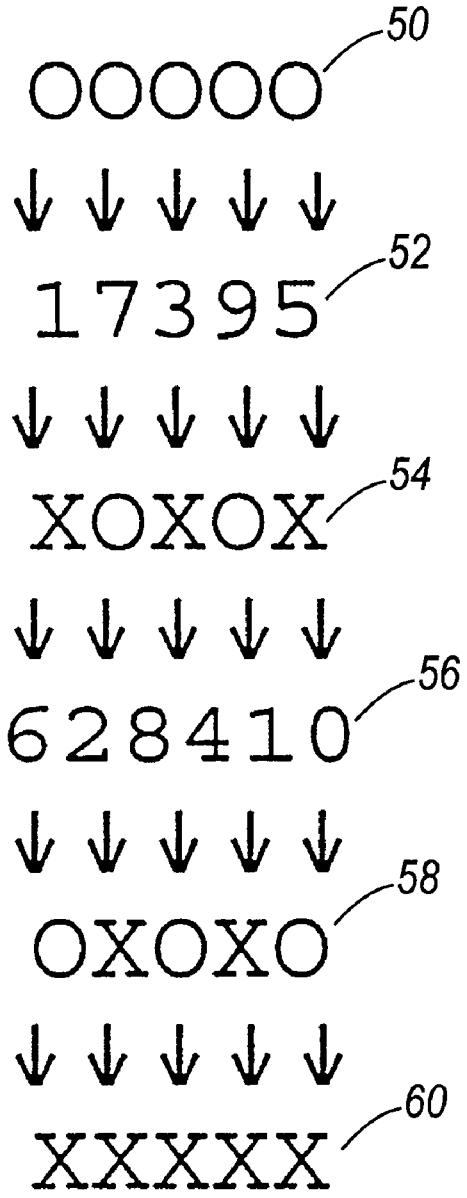
FIGS. 2A and 2B illustrate filler pattern concepts of the present invention.

One example of a filler pattern which may be used in conjunction with the present invention is 1,7,3,9,5 for a first group and 6,2,8,4,10 for a second group, as shown in FIG. 2A. Under this scenario, the number of drops which are to be ejected from droplet ejector 10 to pixel 50 is five. In particular, there will be five droplets ejected onto pixel 50. Using the above-noted filler pattern, prior to any operation, no droplets have been ejected (this state is illustrated by "00000") 52. During a first pass of a printhead, the ejector 10 ejects droplets when filler data (1,7,3,9,5) 52 causes a control signal to activate the acoustic ink ejector. For example, since only five droplets are to be ejected, during the first pass (which uses filler pattern 1,7,3,9,5) an ink droplet will be ejected corresponding to filler pattern data 1, 3 and 5. Since data 7 and 9 are above the input print level (i.e. five), no droplets are ejected corresponding to this data (X0X0X) 54. As can be seen, during the first pass, the time between the first ejection of a droplet (i.e. from the time the ejector received filler pattern data "1"), until the ejector 10 ejects a second droplet due to filler pattern data "3", is doubled from a system which ejects drops in an adjacent manner. When the acoustic ink ejector 10 received the filler pattern data "7", it was noted to not be within the input level and therefore, no droplet was ejected.

During a second pass, the filler pattern, 6,2,8,4,10, 56, results in droplets being ejected corresponding to filler pattern data "2" and "4" resulting in a pattern OXOXO, 58. By operation of the first and second passes, all five droplets (XXXXX) 60 are appropriately ejected. However, since time was inserted between each of the ejections, i.e. there is no sequential ejection, and the surface of the ink was able to settle thereby allowing proper directionality of the ink droplets.

Figure 2B:
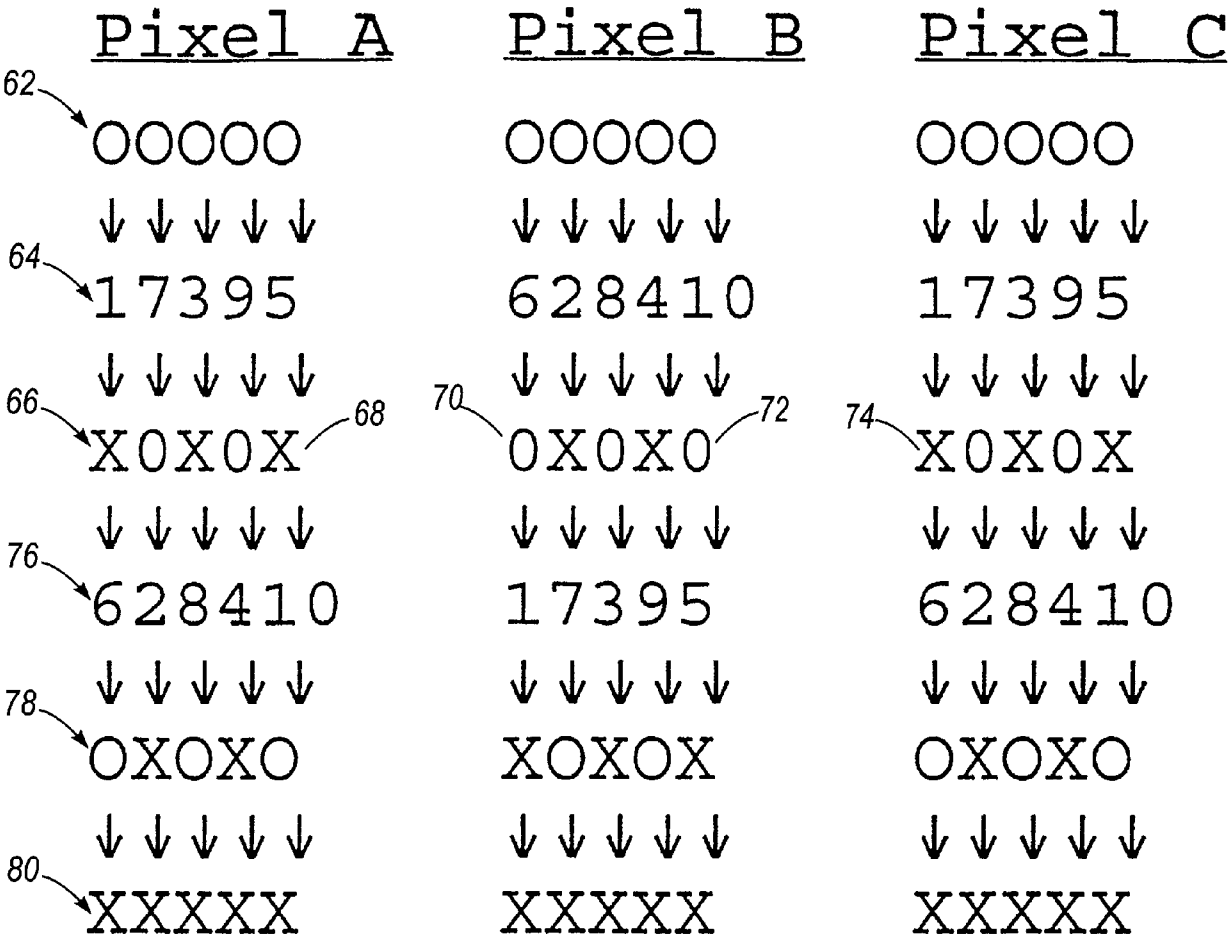

Turning to another aspect of the present invention, and FIG. 2B, pixels A, B and C are shown in a state prior to operation (Pixel A—00000; Pixel B—00000; Pixel C—00000) 62. Using the previously discussed filler pattern 64, following a first pass not only are there no adjacent ink droplets ejected within pixel A, (i.e. the pattern of Pixel A is—X0X0X; the pattern of Pixel B is—0X0X0; and the pattern of Pixel C is—X0X0X) 66, but there also are no adjacent ink droplet ejections at the borders between the pixels. For example, an ink droplet ejection occurs in pixel A in response to filler pattern data "5" 68, and the next time period there is no ejection of an ink droplet in pixel B, since the next filler pattern data is "6" 70. The same is true between pixel B at space 72 and Pixel C at space 74. For the second pass, the remaining filler pattern data is applied 76. Specifically, Pixel A now has applied to it the filling pattern 6,2,8,4,10 (second pass, Pixel A is—0X0X0), pixel B has the filling pattern 1,7,3,9,5 (second pass, Pixel B is—X0X0X), and pixel C has the filling pattern 6,2,8,4,10 (second pass, Pixel C is—0X0X0) 78. The remaining ink droplets necessary for the image are ejected 80.

Using the droplet maximum and the described filler patterns, it is possible to provide up to five drops with no two drops being printed on adjacent cycles. So after a drop is fired, the present invention provides for twice the settling time as opposed to systems which perform adjacent or sequential droplet ejection. By increasing the time period between droplet ejections in non-black/shadow areas, it is possible to increase the overall operational speed of the acoustic ink printer. As previously noted, the highest optimal speed acoustic ink printers have been approximately 48 kHz or less. Under this new design, the inventors have determined that it is possible to deliver ink with an equivalent level of print quality using 40 kHz or greater, with a speed up to 55 kHz operation, which is approximately a 15% increase in speed. This provides for the overall printing system to increase the throughput of page printing.

It is to be appreciated that when printing in lighter areas such as those with an input level of five droplets per pixel, i.e. half the ten pixels to which the system can print, the printing is actually printing at approximately ½ of 55 khz which is 27.5 kHz. As more ink drops are required per pixel, the rate goes up. By the time the system is asked to print six drops, the printing is in an area that is at the dark end of the spectrum. It is approximately 75% of the maximum optical density for most ink and media combinations.

Printing using a filler pattern such as described, the black/shadow patterns are likely to be somewhat darker than in existing systems because the drops are spread more evenly across the paper. Thus, droplet "6" is occurring in the image black/shadows (not in the light or mid-tone areas). Misdirectionality errors are likely to be much less noticeable in these black/shadow regions. In fact, some misdirectionality is actually helpful to fill out the image and provide darker, more saturated colors by ensuring greater coverage of the paper.

While the increase in misdirectionality is helpful in the middle or solid dark objects, it can degrade image quality at the edges. Thus it can be helpful to avoid firing drops on adjacent time cycles at the edges of objects. This may require adjustments in the pattern of drops. For example, for an object at full density, at the edges perpendicular to the process direction, patterns XOXXX and XXXOX might be used for left and right edges respectively. For edges parallel to the process direction patterns OXOXO and XOXOX are preferred.

FIGS. 2A and 2B are directed to a single acoustic ink ejector, such as depicted in FIG. 1. So what is being discussed about pixels are pixels created along a line. What has therefore been described is directed to a single ejector as a device, and that there is a desire to minimize the repetition of that device in pixel ejection. In particular, there is a desire to generate a droplet ejection sequence to obtain, if possible, non-adjacent droplet ejections.

Figure 3:
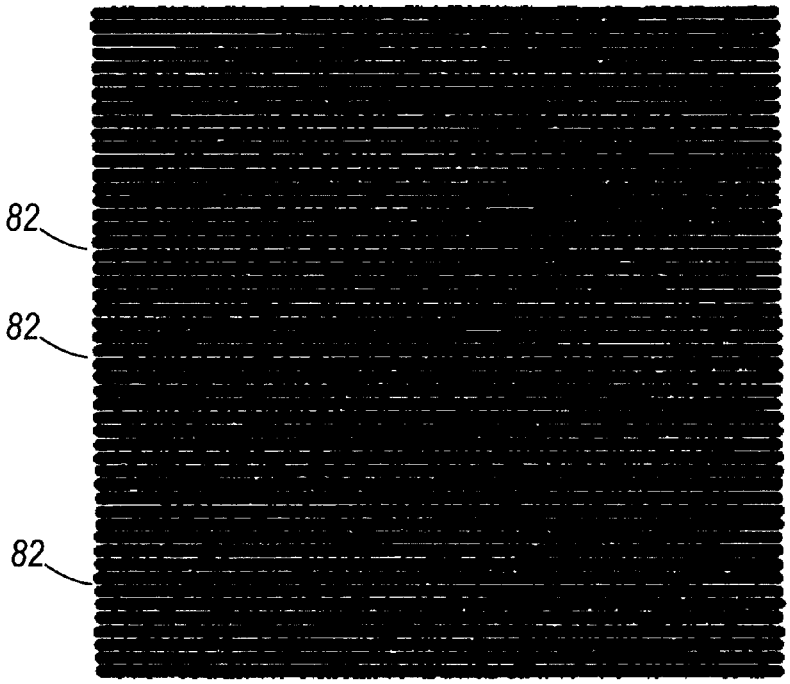
FIG. 3 illustrates a printout output of high directionality control in a shadow or black print area.
Figure 4:
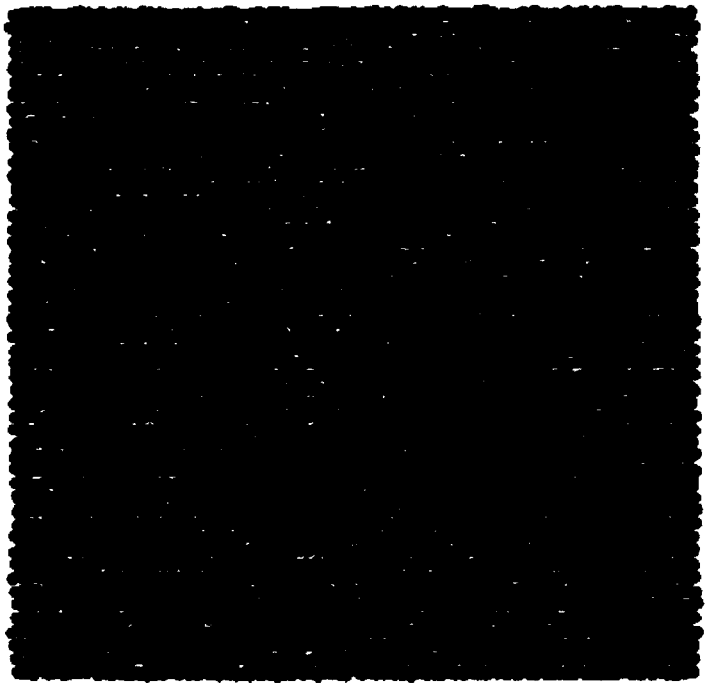
FIG. 4 illustrates the misdirectionality benefits achieved in dark areas.

This concept is discussed in connection with FIGS. 3 and 4. FIG. 3 depicts an example of a 10-drop simulation with underfilling spots and 2 micron misdirectionality (1 sigma). In particular, FIG. 3 illustrates the output of an acoustic ink printer operating at a speed no greater than 48 kHz such that misdirectionality is minimized. FIG. 4 shows the results of the same printing characteristics but with 5 micron misdirectionality. It can be seen the image in FIG. 4 has a coverage that is greater with less visible line structures than FIG. 3.

In FIG. 3, by maintaining the directionality levels within the dark area, the ink is being applied to the paper on a substantially straight line, allowing an observer user to see line patterns 82. However, with increased misdirectionality which would occur in the present invention (and shown in FIG. 4), an observer perceives a darker paper due to the lack of the line patterns, and slightly better coverage on the paper. In other words the droplets are scattered in less than optimal line placement, which eliminates the noticeable line patterns.

Figure 5:
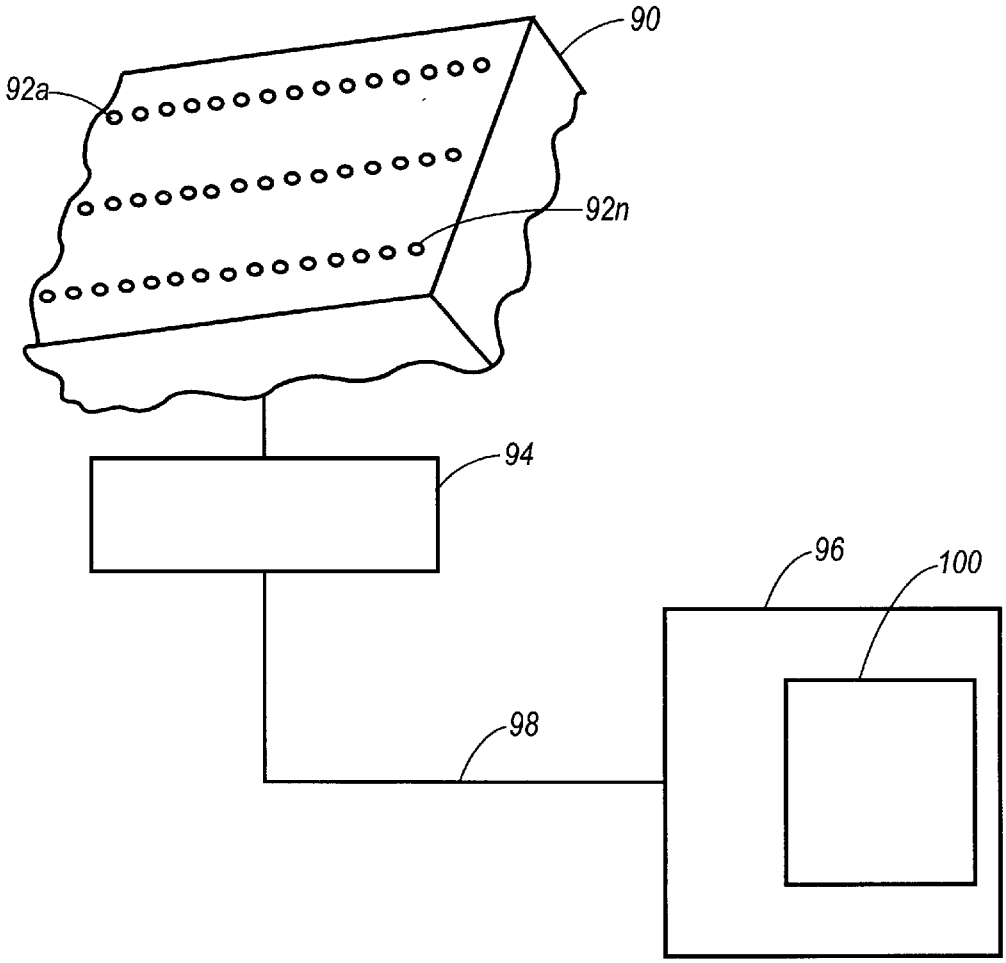
FIG. 5 depicts configuration of the present invention in connection with an acoustic ink printhead.

Turning attention to FIG. 5, shown is a block diagram of a printhead 90 having multiple ejectors 92*a*–92*n* which are fired in accordance with actuation of rf power source 94. A controller 96 provides control signal 98 to the rf power source which is configured through either a plurality of individual rf power sources or multiplexing designs for a single rf source, to actuate ink ejectors 92*a*–92*n*. With attention to the filler pattern, such patterns may be stored in a look-up table 100 within controller 96 or external thereto. Use of lookup table 100 provides a fast manner of obtaining the filler pattern data information which is used by controller 96 to generate control signals 98 for rf power source assembly 94. Thus, while the discussion of FIGS. 1, 2A and 2B have been substantially in connection with a single ink droplet ejector, the present invention is applicable to an entire printhead where each individual ink jet ejector 92*a*–92*n* is operated in accordance with individualized filler pattern data associated therewith.

It has been noted that the present invention will allow for an increase in the operational speed of acoustic ink printers. However, the present invention is also beneficial for acoustic ink printheads which have already been designed. When a given printhead has been designed, the design essentially freezes the firing or operational speed of the printhead. Therefore, while the concepts of the present invention are especially beneficial for increasing the speed of future designs, there are also benefits for existing conventionally designed systems. By relaxing the directionality constraints when in a shadow or dark area, the ink types which may be used with existing systems may be broadened. Particularly, inks with lower surface tension may be used in existing systems when the concepts of providing unique filler patterns are implemented. Use of lower surface tension inks can allow for a faster drying (though the inks would still be slow dry in an absolute sense) and potentially relax the requirements on the drying system.

Thus, the present invention provides a manner of increasing the speed at which acoustic ink printers operate while at the same time maintaining directionality within non-dense color areas, and beneficially using misdirectionality which will occur due to the high operational speeds when in shadow or black areas. In addition to allowing a printer to operate at faster speeds, in devices where the speed is already fixed, the use of unique filling patterns can lead to an expanded use of different ink types that may be incorporated within the acoustic ink printing system.

It is to also be noted that while some examples of fill patterns are described, there are numerous calculations available to generate sophisticated fill patterns which avoid sequential ink droplet ejection. It is to also be noted that while the present invention was described in conjunction with a maximum of ten droplets per pixel, systems having a larger or smaller number may also incorporate the concepts of the present invention.

There are numerous ways that images can be processed to insure that drops are not fired on adjacent time cycles, for example, 1. Halftoning at high addressability may be used; or 2. Feedback controlled dithering (such as error diffusion) such that the threshold is increased on subsequent time cycles.

However, an important aspect of the present invention is that adjacent firing of drops is avoided. While specific implementations have been shown to avoid adjacent firings, it is, again, understood other processes may exist and these should be considered within the scope of the described broader concept.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention it is now claimed:

1. An acoustic ink ejector assembly comprising:

a supply of liquid ink with a free ink surface;

an acoustic ink droplet ejector, acoustically linked to the supply of liquid ink;

a rf power source coupled to the acoustic droplet ejector for exciting the droplet ejector to radiate the free ink surface with substantially focused acoustic power pulses, whereby individual droplets of ink are ejected from the free ink surface;

a controller in operational connection with the rf power source, the controller generating and issuing control signals to the rf signal source to cause the rf signal source to excite the acoustic ink droplet ejector such that the individual droplets are ejected in accordance the received control signals; and a filler pattern used by the controller to determine when the control signals are to be issued to the rf signal source, the control signals determining an order in which droplets are to be ejected from the ejector, such that the selected pattern avoids adjacent firing until a substantial portion of the ejector cycles are filled.

2. The assembly according to claim 1 wherein the selected fill pattern prohibits control signals from being issued to the rf power source until the substantial portion of ejector cycles are filled.

3. The assembly according to claim 1 wherein the assembly operates at a rate greater or equal to 40 kHz.

4. The assembly according to claim 1 wherein the filler pattern consists of at least eight digits placed into two separate groups, and wherein droplets are ejected from the droplet ejector at a first time in accordance with data in a first one of the two groups and at a second time in accordance with data in a second one of the two groups.

5. The assembly according to claim 1 wherein when a filler pattern contains data that will cause x droplets or less to be ejected within a predetermined area, the ink droplet ejector is generating an image of a first density, and when the filler pattern contains data that will cause greater than x droplets to be ejected in the predetermined area, the ink droplet ejector is generating an image of a second density which is greater than the first density.

6. The assembly according to claim 5 wherein when the filler pattern causes greater than x droplets to be ejected, at least two of the droplets will be ejected at immediately adjacent time periods.

7. The assembly according to claim 1 wherein a surface tension of the liquid ink is lower than the surface tension of an ink used in an ink ejector assembly not employing a filler pattern.

8. A method of ejecting ink droplets from an acoustic ink ejector assembly having a supply of liquid ink with a free ink surface, an acoustic ink droplet ejector, acoustically linked to the supply of liquid ink, a rf power source coupled to the acoustic droplet ejector, and a controller in operational connection with the rf power source, the method comprising the steps of:

providing image data to the controller;

choosing a threshold density of drops;

processing the image data to determine the firing pattern, such that an ejector is not fired on subsequent time cycles until the density exceeds threshold;

generating, by the controller, control signals in accordance with the firing pattern;

supplying the control signals to the rf power source;

exciting the droplet ejector to radiate the free ink surface with substantially focussed acoustic power pulses, in accordance with the control signals supplied to the rf power source; and ejecting individual droplets of ink from the free ink surface in accordance with the filler pattern, wherein the filler pattern includes data representing a desired sequence of the ink droplet ejection.

9. The method according to claim 8 wherein the filler pattern prohibits ejection of ink droplets in immediately adjacent time periods, until a predetermined state is reached.

10. The method according to claim 8 wherein the assembly operates at a rate greater than or equal to 40 kHz.

11. The method according to claim 8 wherein the filler pattern consists of at least eight digits placed into two separate groups, and wherein droplets are ejected from the droplet ejector at a first time in accordance with data in a first one of the two groups and at a second time in accordance with data in a second one of the two groups.

12. The method according to claim 8 wherein when a filler pattern contains data that will cause x droplets or less to be ejected, the ink droplet ejector is generating an image of a first density, and when the filling pattern contains data that will cause greater than x droplets to be ejected, the ink droplet ejector is generating an image of a second density which is greater than the first density.

13. The method according to claim 12 wherein following ejection of a ink droplet, the surface of the ink is permitted to settle to a level which allows for desired ejection directionality, prior to ejection of a second ink droplet when the ink ejector is generating the image of the first density.

14. The method according to claim 8 wherein a surface tension of the liquid ink is lower than the surface tension of an used in an ink ejector assembly not employing a filler pattern.

15. The method according to claim 8 wherein the acoustic ink ejector assembly is designed to eject a maximum of ten droplets in a predefined area.

16. The method according to claim 15 wherein the filler pattern is designed to allow up to five ink droplets to be deposited in the predefined area without any two ink droplets being ejected immediately adjacent in time to another ejected ink droplet.

17. An acoustic ink printer including a printhead having a supply of liquid ink with a free surface; an acoustic ink cavity containing the ink, with one end of the cavity being defined by the free ink surface; a droplet ejector acoustically coupled to the ink; and a rf power source coupled to the droplet ejector for exciting the droplet ejector to radiate the free ink surface with substantially focused acoustic power pulses, whereby individual droplets of ink are ejected from the free ink surface on command at a controlled ejection velocity, the acoustic ink printer comprising:

a controller in operational connection with the rf power source, the controller generating and issuing control signals to the rf power source to cause the rf signal source to excite the acoustic ink droplet ejector such that individual droplets are selectively ejected; and a filler pattern used by the controller to determine when the control signals are to be issued to the rf power source, the control signals determining an order in which droplets are to be ejected from the ejector.

18. The acoustic ink printer according to claim 17 wherein when a filler pattern contains data that will cause x droplets or less to be ejected within a predetermined area, the ink droplet ejector is generating an image of a first density, and when the filler pattern contains data that will cause greater than x droplets to be ejected in the predetermined area, the ink droplet ejector is generating an image of a second density which is greater than the first density.

19. The acoustic ink printer according to claim 18 wherein when printing an image of the first density ink droplets are ejected at a predicable directionality, and when printing an image of the second density ink droplets are ejected with unpredictable directionality.

20. The acoustic ink printer according to claim 17 wherein the printer operates at a rate greater than or equal to 40 kHz.

* * * * *